US010751261B2

(12) United States Patent
Badger

(10) Patent No.: US 10,751,261 B2
(45) Date of Patent: Aug. 25, 2020

(54) HYGIENIC PACIFIER WITH ANNULAR SHIELD FOLDING STRUCTURE AND METHOD OF MANUFACTURING SAME

(71) Applicant: Doddle & Co, LLC, Montclair, NJ (US)

(72) Inventor: Janna Badger, Sandy, UT (US)

(73) Assignee: DODDLE & CO., LLC, Montclair, NJ (US)

( * ) Notice: Subject to any disclaimer, the term of this patent is extended or adjusted under 35 U.S.C. 154(b) by 183 days.

(21) Appl. No.: 15/974,321

(22) Filed: May 8, 2018

(65) Prior Publication Data

US 2018/0256454 A1 Sep. 13, 2018
US 2020/0022881 A9 Jan. 23, 2020

Related U.S. Application Data

(63) Continuation-in-part of application No. 15/294,206, filed on Oct. 14, 2016.

(51) Int. Cl.
*A61J 17/00* (2006.01)

(52) U.S. Cl.
CPC ..... *A61J 17/008* (2015.05)

(58) Field of Classification Search
CPC ..... A61J 17/00; A61J 17/001; A61J 17/002; A61J 17/003; A61J 17/005; A61J 17/006; A61J 17/007; A61J 17/008; A61J 17/02
USPC ..... 606/234, 235, 236
See application file for complete search history.

(56) References Cited

U.S. PATENT DOCUMENTS 3,363,630 A 1/1968 Hines
3,653,610 A 4/1972 Owen
5,211,656 A 5/1993 Maddocks et al.
5,366,481 A 9/1994 Zade
5,578,058 A 11/1996 Chen
D397,216 S 8/1998 Armand
6,066,162 A 5/2000 Hudson
6,161,710 A 12/2000 Dieringer et al.
9,271,900 B2 3/2016 Badger et al.
2002/0087191 A1 7/2002 Huang
2003/0032984 A1 2/2003 Hakim
(Continued)

FOREIGN PATENT DOCUMENTS

GB 2487667 A 8/2012

OTHER PUBLICATIONS

U.S. Patent and Trademark Office, Notice of Allowance issued in related U.S. Appl. No. 15/056,507 dated May 15, 2018.
(Continued)

*Primary Examiner* — Kathleen S Holwerda
*Assistant Examiner* — Kankindi Rwego
(74) *Attorney, Agent, or Firm* — Middleton Reutlinger

(57) ABSTRACT

A hygienic pacifier includes an annular folding structure formed on a substantially spherical shield that joins a nipple to a faceplate and that is movable between a recoiled storage position in which the shield substantially surrounds the nipple and an extended use position in which at least a portion of the nipple projects through the nipple access opening and is exposed for use. The annular folding structure may be used to bias the shield to remain in the extended use position when the shield is placed in the extended use position. Further, in some instances, the annular folding structure may be configured to provide a bias that may be overcome by a moderate impact to the pacifier such as an impact associated with dropping the pacifier.

20 Claims, 8 Drawing Sheets

(56) References Cited

U.S. PATENT DOCUMENTS

| | | | |
|---|---|---|---|
| 2003/0100922 | A1 | 5/2003 | Fitzpatrick et al. |
| 2003/0208234 | A1 | 11/2003 | Thornton et al. |
| 2004/0088005 | A1 | 5/2004 | Boyd |
| 2008/0046011 | A1 | 2/2008 | Brown |
| 2008/0078366 | A1 | 4/2008 | Fienup et al. |
| 2008/0210655 | A1 | 9/2008 | Rees et al. |
| 2009/0108009 | A1 | 4/2009 | Yeung |
| 2009/0192547 | A1 | 7/2009 | Gates |
| 2009/0248074 | A1 | 10/2009 | Kliegnam et al. |
| 2011/0160769 | A1 | 6/2011 | Tesini et al. |
| 2011/0288585 | A1 | 11/2011 | Boughalem |
| 2012/0265245 | A1 | 10/2012 | Yamashita |
| 2012/0283774 | A1 | 11/2012 | Cudworth et al. |
| 2013/0331887 | A1 | 12/2013 | Subramanian |
| 2014/0257387 | A1 | 9/2014 | Saxton |
| 2016/0175202 | A1 | 6/2016 | Badger et al. |
| 2016/0296424 | A1 | 10/2016 | Eerden |
| 2017/0333294 | A1 | 11/2017 | Brown |
| 2018/0104158 | A1 | 4/2018 | Badger et al. |

OTHER PUBLICATIONS

U.S. Patent and Trademark Office, Office Action issued in related U.S. Appl. No. 13/956,232 dated May 7, 2015.

U.S. Patent and Trademark Office, Notice of Allowance issued in related U.S. Appl. No. 13/956,232 dated Oct. 28, 2015.

PCT International Search Report and Written Opinion for PCT/US16/57221 dated Jan. 13, 2017.

U.S. Patent and Trademark Office, Office Action issued in related U.S. Appl. No. 15/056,507 dated Dec. 18, 2017.

U.S. Patent and Trademark Office, Non-Final Office Action issued in related U.S. Appl. No. 29/581,016 dated Aug. 10, 2018.

"PishPoshBlog—All New Doddle Pop Pacifier" Found online Aug. 1, 2018 at site.pishposhbaby.com. Retreived from URL: http://site.pishposhbaby.com/blog/2015/08/07/all-new-doddle-pop-pacifier/. Page dated Aug. 7, 2015.

"Kickstarter—Doddle Pop—The Clean Pacifier" Found online Aug. 2, 2018 at www.kickstarter.com. Retreived from URL: http://www.kickstarter.com/projects/104061129/doddle-pop-the-clean-pacifier/updates. Page dated Oct. 17, 2015.

"Archive—Doddle and Co." Found online Aug. 2, 2018 at doddleandco.com. Retreived from URL: https://web.archive.org/web/20160426114156/https://doddleandco.com/. Page dated Apr. 26, 2016.

"Doddle and Co the Pop Pacifier" Found online Aug. 2, 2018 at www.amazon.com. Retreived from URL: https://www.amazon.com/Doddle-Co-Pop-Cleaner-Pacifier/dp/B06XKLKJTJ?th=1. Page dated Apr. 3, 2017.

U.S. Patent and Trademark Office, Restriction Requirement issued in related U.S. Appl. No. 15/294,206 dated Sep. 4, 2018.

U.S. Patent and Trademark Office, Notice of Allowance issued in related U.S. Appl. No. 29/581,016, dated Jan. 2, 2019.

PCT International Search Report and Written Opinion for PCT/US19/031080 dated Aug. 7, 2019.

U.S. Patent and Trademark Office, Final Office Action issued in related U.S. Appl. No. 15/294,206, dated Jun. 20, 2019.

U.S. Patent and Trademark Office, Office Action issued in related U.S. Appl. No. 15/294,206 dated Jan. 6, 2020.

HYGIENIC PACIFIER WITH ANNULAR SHIELD FOLDING STRUCTURE AND METHOD OF MANUFACTURING SAME

BACKGROUND

Pacifiers, also known by various alternative terms such as soothers or dummies, are commonly used to sooth young children. Most pacifiers include some form of nipple, or teat, affixed to a mouthguard or faceplate that is large enough to prevent a child from choking or swallowing. One common drawback to many pacifiers is that the nipple is uncovered such that whenever the pacifier is dropped, the nipple can contact the ground and pick up dirt and other contaminants. Some pacifier designs have therefore attempted to address this problem by recessing a nipple within an enclosure such that when the pacifier is dropped, the nipple is at least partially enclosed within the enclosure.

SUMMARY

The invention addresses these and other issues associated with the art by providing a hygienic pacifier where the hygienic pacifier includes an annular folding structure formed on a substantially spherical shield that joins a nipple to a faceplate and that is movable between a recoiled storage position in which the shield substantially surrounds the nipple and an extended use position in which at least a portion of the nipple projects through the nipple access opening and is exposed for use. The annular folding structure may be used to bias the shield to remain in the extended use position when the shield is placed in the extended use position. Further, in some instances, the annular folding structure may be configured to provide a bias that may be overcome by a moderate impact to the pacifier such as an impact associated with dropping the pacifier.

Therefore, consistent with one aspect of the invention, a hygienic pacifier may include a nipple having a base, a faceplate defining a nipple access opening, and a substantially spherical shield joining the nipple to the faceplate and being movable between a recoiled storage position in which the shield substantially surrounds the nipple and an extended use position in which at least a portion of the nipple projects through the nipple access opening and is exposed for use, where the shield includes an annular folding structure defined thereon that biases the shield to maintain the shield in the extended use position.

In some embodiments, the shield is biased to the recoiled storage position, and the annular folding structure is configured to overcome the bias of the shield when the shield is in the extended use position. Also, in some embodiments, the annular folding structure is configured to bias the shield to maintain the shield in the extended use position in an absence of an external impact force, and the shield is configured to overcome the bias of the annular folding structure in the presence of an external impact force. Further, in some embodiments, the annular folding structure is configured to bias the shield to maintain the shield in the extended use position when an infant ceases sucking on the nipple, and the shield is configured to overcome the bias of the annular folding structure when the pacifier is dropped.

In some embodiments, the annular folding structure is configured to bias the shield to maintain the shield in the extended use position in the presence of an external impact force. In addition, in some embodiments, the nipple access opening of the faceguard is sized and configured to frictionally engage the base of the nipple to further restrict return of the nipple to the recoiled storage position when the shield is in the extended use position.

In some embodiments, the annular folding structure defines a crease line on an interior of the shield. In addition, in some embodiments, the crease line is positioned on a faceplate side of a midpoint of the shield along an axis substantially parallel to the nipple such that when the shield is in the extended use position, the base of the nipple contacts the faceplate before the shield can fully fold over. Moreover, in some embodiments, a first distance from the crease line to the faceplate along an axis substantially parallel to the nipple is less than a second distance from the crease line to the base of the nipple along the axis such that when the shield is in the extended use position, the base of the nipple contacts the faceplate before the shield can fully fold over.

In some embodiments, the shield is thinner proximate a faceplate end of the annular folding structure than proximate a nipple base end of the annular folding structure. Moreover, in some embodiments, the annular folding structure includes a shoulder that is rounded proximate the nipple base end and that defines the crease line proximate the faceplate end. In some embodiments, the shoulder is convex facing inwardly from the shield.

In addition, in some embodiments, the nipple and faceplate are integrally formed with the shield. In some embodiments, the faceplate includes an annular shoulder circumscribing the nipple access opening, where the nipple includes an annular base configured to engage the annular shoulder when the shield is in the extended use position to inhibit overextension of the nipple beyond the nipple access opening. Moreover, in some embodiments, the faceplate includes an annular narrowing shoulder circumscribing the nipple access opening and reducing tension applied by the faceplate on the shield.

Consistent with another aspect of the invention, a hygienic pacifier may include a nipple having a base, a faceplate defining a nipple access opening, and a substantially spherical shield joining the nipple to the faceplate and being movable between a recoiled storage position in which the shield substantially surrounds the nipple and an extended use position in which at least a portion of the nipple projects through the nipple access opening and is exposed for use, where the shield includes an annular ridge defined thereon that biases the shield to maintain the shield in the extended use position.

Also, in some embodiments, the annular ridge includes a shoulder that defines a crease line on an interior of the shield. In some embodiments, the shoulder is rounded proximate a nipple base end of the annular ridge and defines a crease line proximate a faceplate end of the annular ridge. In addition, in some embodiments, a first distance from the crease line to the faceplate along an axis substantially parallel to the nipple is less than a second distance from the crease line to the base of the nipple along the axis such that when the shield is in the extended use position, the base of the nipple contacts the faceplate before the shield can fully fold over. Also, in some embodiments, the shield is thinner proximate a faceplate end of the annular ridge than proximate a nipple base end of the annular ridge.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
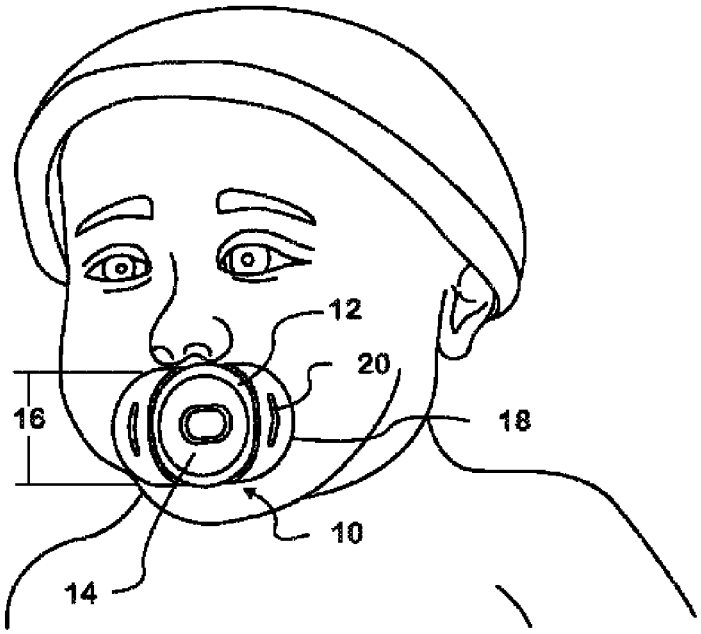
FIG. 1 is a perspective view of an example hygienic pacifier.
Figure 2:
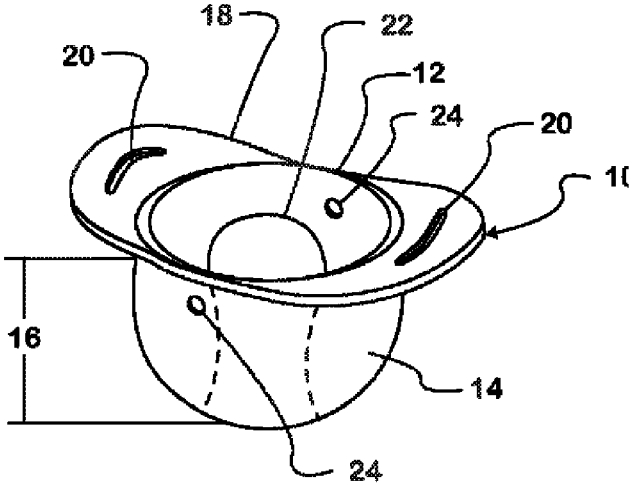
FIG. 2 is a perspective view of the hygienic pacifier of FIG. 1 in a recoiled, storage position.
Figure 3:
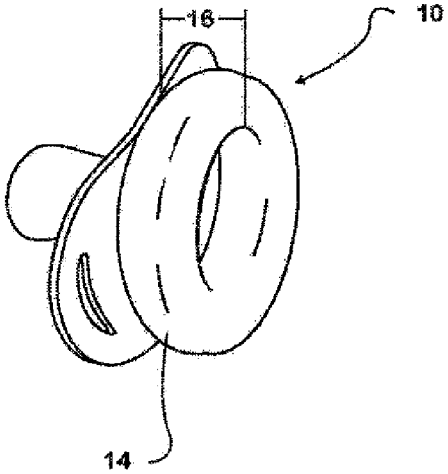
FIG. 3 is a perspective view of the hygienic pacifier of FIG. 1 in an extended, use position.

Turning to the Drawings, wherein like numbers denote like parts throughout the several views, FIGS. 1-3 illustrate an example embodiment of hygienic pacifier 10, e.g., as is disclosed in U.S. Pat. No. 9,271,900, which is incorporated by reference herein. Pacifier 10 includes a base 12 and a shield 14, and shield 14 is recoilable and includes a substantially spherical wall 16, integrally formed with base 12, yet having a thinner cross section than base 12, thereby providing shield 14 with a substantially spherical configuration or position. A concave faceplate 18 is integrally formed with base 12, and may include slits 20 therein. As illustrated in FIG. 2, a nipple or teat 22 may be integrally formed with shield 14. The distance between nipple 22 and shield 14 may be varied, and in some embodiments, suitable saliva exits, such as, for example, apertures 24 illustrated in FIG. 2, may be provided.

FIG. 3 illustrates a perspective view of pacifier 10 of FIGS. 1 and 2, but in an extended, use position. When pacifier 10 is in the use position, a wall 16 of shield 14 is in a substantially toroidal configuration or position. When pacifier 10 is in a recoiled, storage position, e.g., as shown in FIG. 2, wall 16 of shield 14 is in a substantially spherical position. Shield 14 is configured to invert and flip inside out from its storage position as shown in FIG. 2 to its use position as shown in FIG. 3.

As is also shown in FIGS. 2 and 3, faceplate 18 may be concave in some embodiments. In addition, pacifier may be constructed of various materials, e.g., any suitable hygienic, flexible material such as medical grade silicone. In addition, in other embodiments, the distance between shield 14 and nipple 22 may be varied, and in some embodiments, a handle may also be included.

Although any suitable method can be used in forming pacifier 10, some embodiments may form the pacifier via an injection or compression molding process. In some embodiments, a unitary, hygienic pacifier may be formed to provide a shield capable of recoiling from an in use toroidal configuration or position, to a spherical storage configuration or position. The wall of the shield may be formed to enable sufficient recoil of the device from a use position to a storage position, without rendering the device too springy to function in the use position. To this end, various suitable materials can be manipulated to produce recoil properties to ensure functionality of the device. Flexible spheres may be formed to automatically retract the nipple of the pacifier due to the varied thickness and resiliency of the material of the unitary device, and in many instances eliminating the need to apply external forces to retract the nipple to achieve a storage position. A pacifier may also be formed with a shape that is ergonomic, e.g., to make the structure easier to use for children with limited movement.

In some embodiments, for example, a pacifier may be formed using medical or food grade silicone, with the base and nipple of the pacifier formed at a thickness of about 1.5 mm to about 2 mm, but with the shield wall having a reduced thickness of about 0.7 mm to about 1 mm or about 1.5 mm. In addition, the thickness may vary across the structure by increasing in thickness as the material transitions to the end of the sphere nearest the faceplate. Further, the thickness of the faceplate may also range from about 2 mm up to about 7 mm in some embodiments. It will be understood to those of skill in the art that the relative reduction in thickness may be adjusted depending on the recoil characteristics of various materials.

For each material considered, a balance between obtaining the thickest wall possible while retaining the recoil functionality of the device may be considered. Further, the distance between the nipple and the shield wall may be adjusted to vary the suction characteristics of the device. In additional steps, a lanyard may be attached to slits or holes provided in the device. Colorant may also be added to the material while forming the device. The device may also be textured on the exterior to prevent artifacts, such as lint, from adhering to the silicone surface. Further, the spherical shape of the shield may minimize crevices that might otherwise house dirt or debris. It will be appreciated that a spherical shape or configuration may be considered to include both perfect spheres as well as other sphere-like shapes, including ellipsoids, egg shapes, etc. Further, surfaces, edges, ridges and other accoutrements may also be provided on a shield without departing from its substantially spherical configuration. In many embodiments, for example, a shield may be considered to be defined by, at least along a portion of an axis transverse to a faceplate, a series of circular cross-sections that generally decrease in diameter from a maximum diameter cross-section disposed at some point between the opposing ends of the shield and toward both the end proximate the base of the nipple and the end proximate the faceplate.

Figure 4:
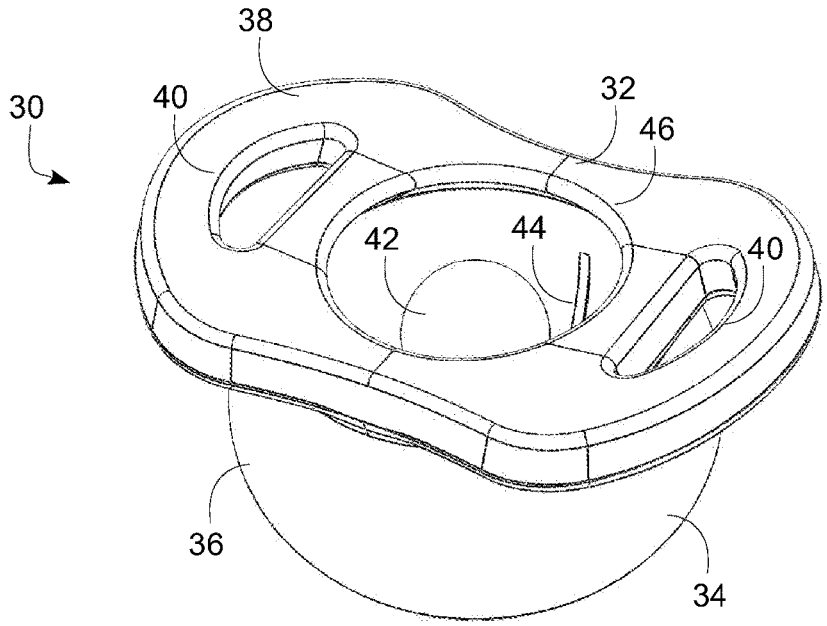
FIG. 4 is a perspective view of another example hygienic pacifier.
Figure 5:
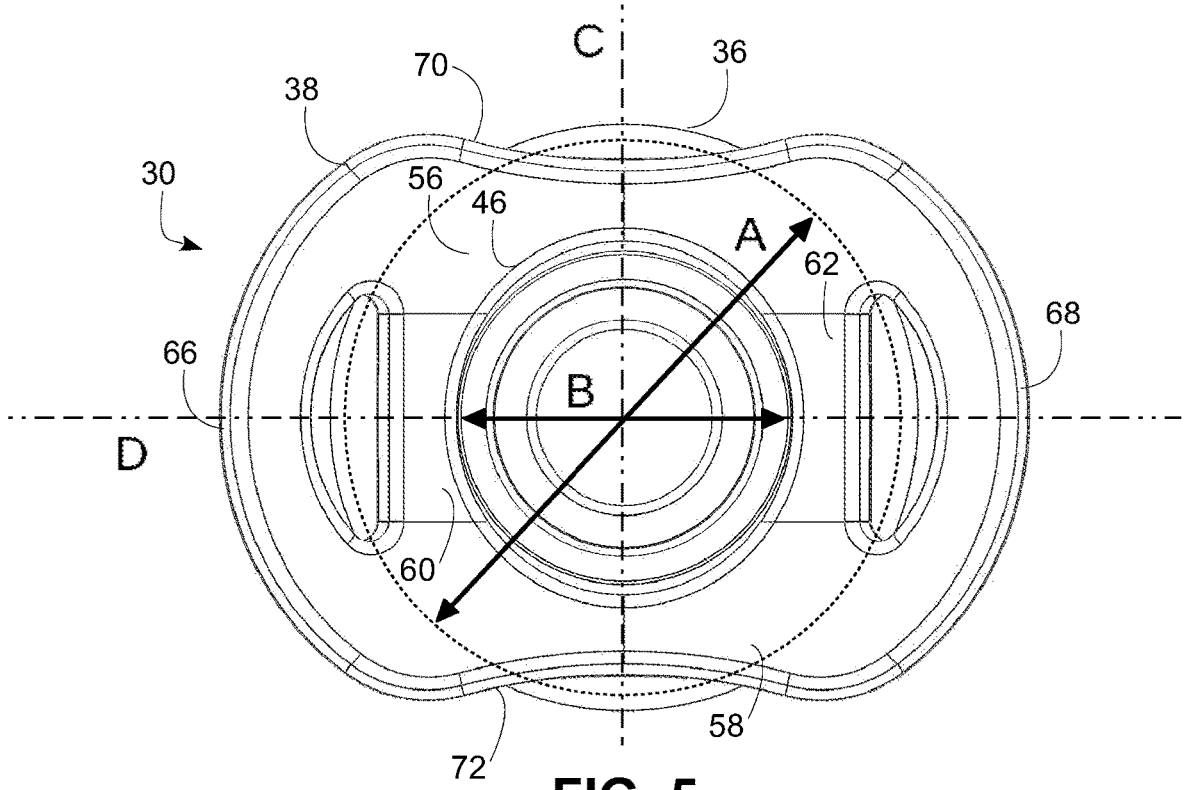
FIG. 5 is a top plan view of the hygienic pacifier of FIG. 4.

Now turning to FIGS. 4 and 5, these figures illustrate a hygienic pacifier 30 consistent with some embodiments of the invention. Pacifier 30 includes a base 32 and a shield 34, and shield 34 includes a substantially spherical wall 36, integrally formed with base 32, yet having a thinner cross section than base 32. A concave mouthguard or faceplate 38 may be integrally formed with base 32, and may include slits 40 therein. As illustrated in FIG. 4, a nipple or teat 42 may be integrally formed with shield 34. The distance between nipple 42 and shield 34 may be varied, and in some embodiments, suitable saliva exits, such as, for example, slits 44 illustrated in FIG. 4, may be provided.

Figure 6:
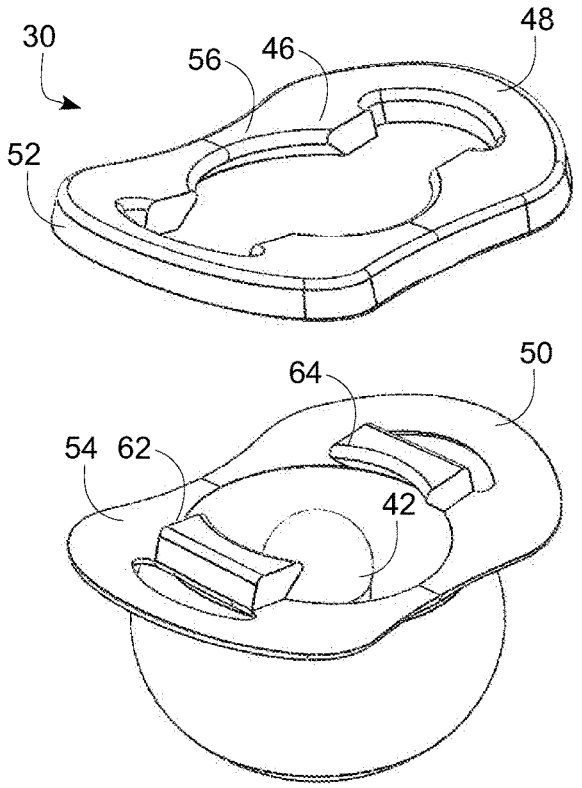
FIG. 6 is an exploded upper perspective view of the hygienic pacifier of FIG. 4.
Figure 7:
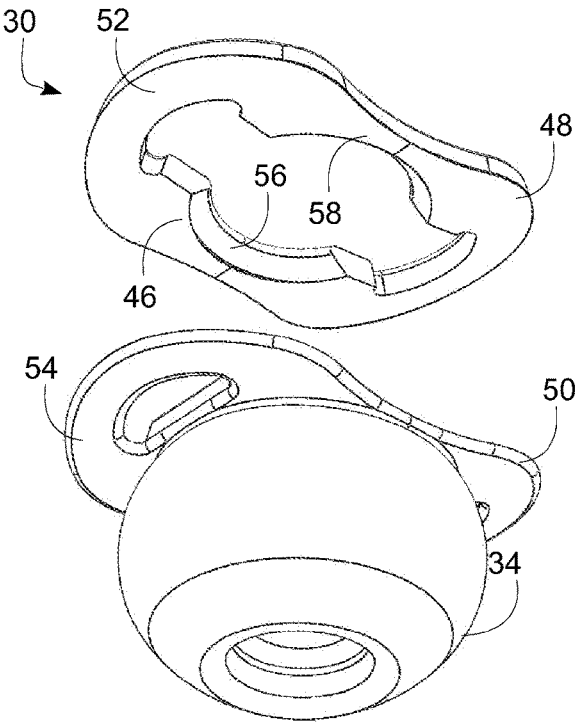
FIG. 7 is an exploded lower perspective view of the hygienic pacifier of FIG. 4.
Figure 8:
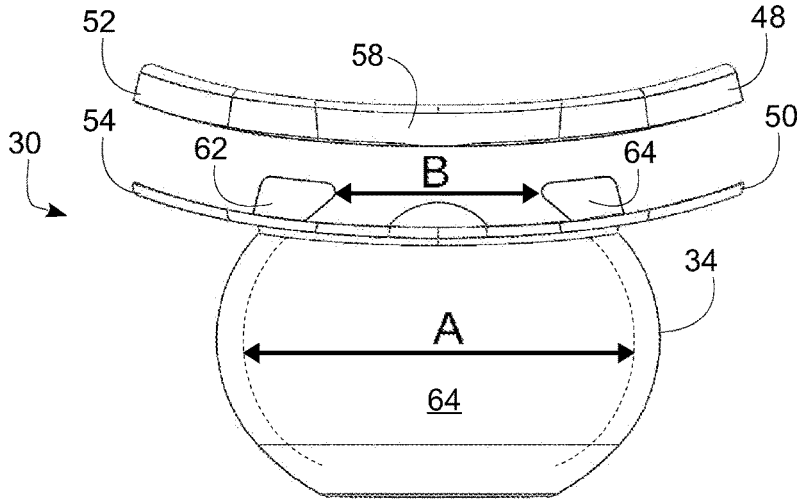
FIG. 8 is an exploded side elevational view of the hygienic pacifier of FIG. 4.

In this embodiment, and with further reference to FIGS. 6-8, pacifier 30 may be formed using a process that incorporates different materials of varying stiffness or durometer, e.g., to provide a faceplate that is stiffer than the shield and/or nipple. In particular, it is desirable in many embodiments to use a stiff faceplate to prevent the entire pacifier from being completely inserted into a child's mouth, which might otherwise introduce swallowing or choking hazards, and which in general is required for compliance with product safety requirements of the United States and other countries and regions. In addition, it may be desirable to minimize the size of a nipple access opening 46 in the faceplate for hygienic purposes. On the other hand, manufacturability concerns may be introduced as a result of using a stiffer material faceplate due to the spherical configuration of the shield 34, as the maximum internal diameter of shield 34 (illustrated at A in FIGS. 5 and 8) is substantially greater than the diameter of opening 46 in faceplate 38. Injection or compression molding of a unitary device of such a configuration generally necessitates the use of a bulbous core to form the inside of the shield, and excessive stiffness in the faceplate proximate opening 46 can impede separation of the device from the core.

As such, in some embodiments it is desirable to provide a multi-durometer faceplate having a nipple access opening that is pliable enough to facilitate removal of a formed pacifier from the bulbous core of a mold, e.g., through the incorporation of one or more break points formed of a lower durometer material that expand during withdrawal of a bulbous core of a mold during a molding process. Through the use of a higher durometer material for at least a portion of a faceplate, appropriate stiffness may be provided in the faceplate in a lighter and more compact form factor than would otherwise be obtainable using the material used for the shield and/or nipple (which would generally necessitate the faceplate to be significantly larger and/or thicker in order to meet product safety requirements). In the embodiment illustrated in FIGS. 4-8, for example, a pacifier may be formed from two materials, a first, higher durometer material 48 such as plastic or silicone and a second flexible and lower durometer material 50 such as silicone, latex or rubber. Other relatively stiff and/or relatively flexible materials may be used in other embodiments.

Faceplate 38, in particular, may be formed from two layers 52, 54, with layer 54 integrally formed with both shield 34 and nipple 42, and with layer 52 being disposed on an opposite side of faceplate 38 from shield 34. In some embodiments, for example, a co-injection molding process may be used to simultaneously mold materials 48, 50. In other embodiments, an overmolding or compression molding process may be used whereby material 48 is first molded and then inserted into a second mold prior to molding of material 50.

In addition, in this embodiment, opening 46 is defined by multiple materials circumscribing the opening. With reference to the orientation of pacifier 30 illustrated in FIG. 5, and with the understanding that references to particular directions are not limiting and are made solely to simplify the discussion hereinafter, it may be seen that top and bottom circumferential portions 56, 58 of opening 46 are defined by layer 52 formed of material 48, while left and right circumferential portions 60, 62 of opening 46 are defined by layer 54 formed of material 50. As material 50 is generally more flexible and pliable than material 48, circumferential portions 60, 62 function as break points to increase the overall pliability of opening 46 and therefore facilitate withdrawal of the bulbous core of the mold (partially illustrated at 64 in FIG. 8) by enabling opening 46 to expand during withdrawal of the bulbous core of the mold. In addition, in some embodiments circumferential portions 60, 62 may serve as tabs to assist in removing material 50 from a mold, and it will be appreciated that these tabs are received within corresponding notches formed in layer 52, and that these tabs effectively expand the nipple access opening during withdrawal of the bulbous core used to form the inner surface of the shield.

Moreover, because top and bottom circumferential portions 56 and 58 are formed of the relatively stiffer material 48 folding of pacifier 30 about a vertical axis C is restricted, further reducing swallowing or choking hazards. Likewise, folding about a horizontal axis (e.g., a major axis of the faceplate, labeled D in FIG. 5) is likewise restricted due to the relatively stiffer material 48 provided on left and right wing portions 66, 68 of faceplate 38. The provision of stiffer material in top and bottom circumferential portions 56, 58 also enables circumferential portions 56, 58 to be narrower in a vertical direction such that faceplate 34 may be provided with concave top and bottom edges 70, 72, which may serve as nose cutouts in some embodiments. It will be appreciated that different numbers, sizes and/or positions of stiffer and/or pliable portions circumscribing the nipple access opening 46 may be used in different embodiments.

Further, the provision of a stiffer material for at least a portion of faceplate 34 may provide improved hygiene, as the generally convex top surface of faceplate 34 is better maintained when the pacifier is dropped, thereby decreasing the surface area of the faceplate and/or nipple that makes contact with the ground and other surfaces.

Figure 9:
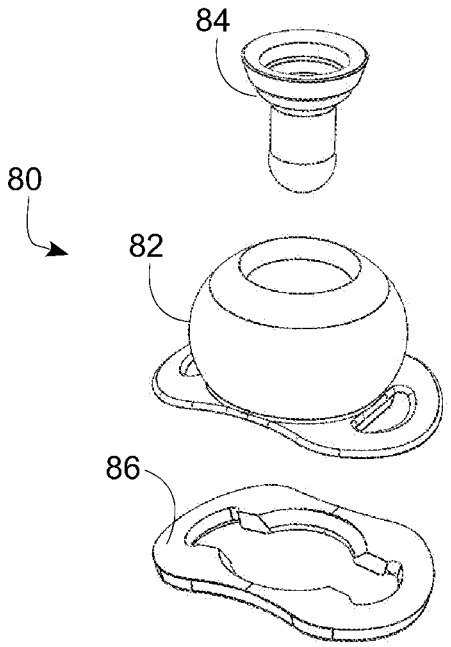
FIG. 9 is an exploded perspective view of another example hygienic pacifier.

In the embodiment of FIGS. 4-8, it may be seen that shield 34 and nipple 42 may be integrally formed together and thus may be formed of the same material. In other embodiments, e.g., as illustrated by pacifier 80 of FIG. 9, it may be desirable to form a shield 82 and nipple 84 separately and/or from separate materials. In such embodiments, for example, both nipple 84 and faceplate 86 may be separately molded and then shield 82 may be overmolded over both components. Doing so enables a multi-durometer faceplate 86 to be formed in a similar manner to pacifier 30, but also enables nipple 84 to be formed of a different material than shield 82, e.g., to use higher durometer materials for the nipple suitable for different ages of infants.

Figure 10:
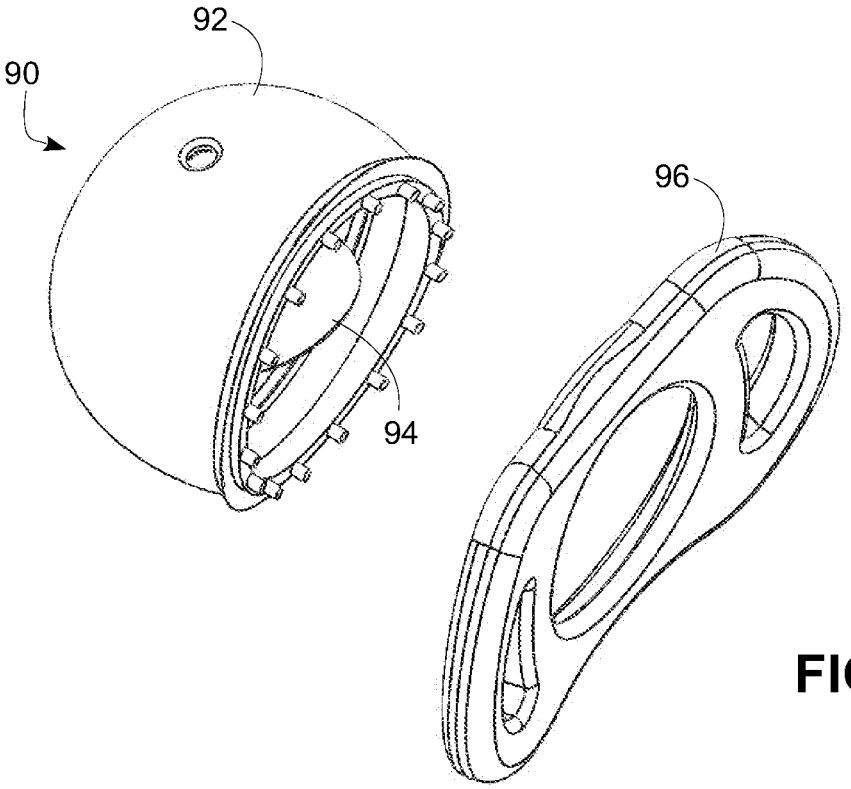
FIG. 10 is an exploded perspective view of yet another example hygienic pacifier.
Figure 11:
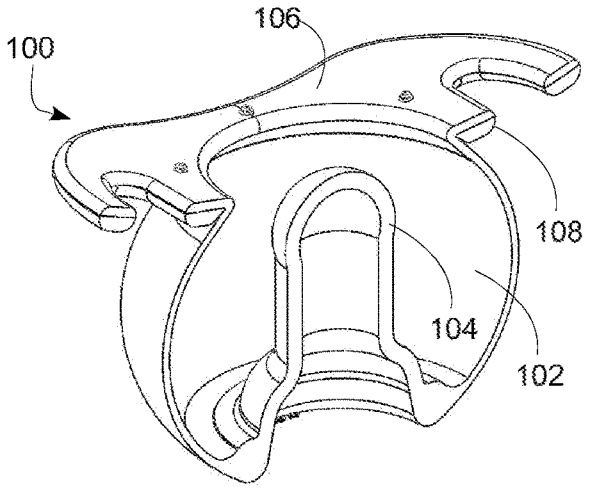
FIG. 11 is a cross-sectional perspective view of another example hygienic pacifier.
Figure 12:
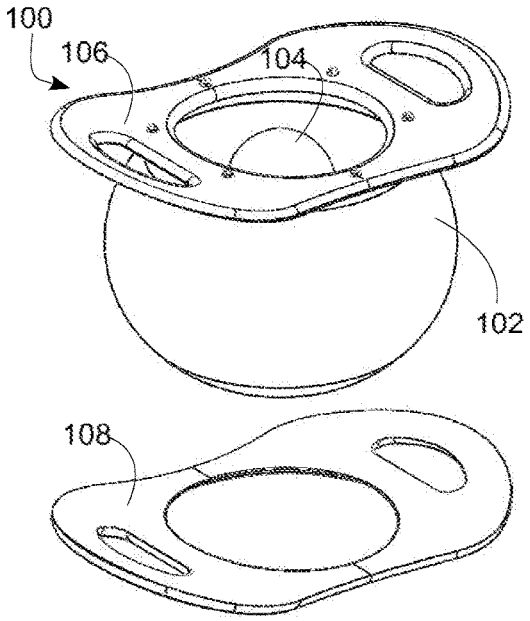
FIG. 12 is an exploded perspective view of the hygienic pacifier of FIG. 11.
Figure 13:
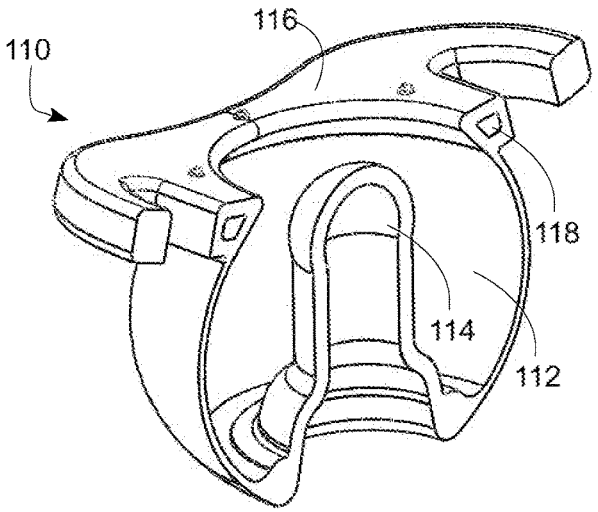
FIG. 13 is a cross-sectional perspective view of another example hygienic pacifier.
Figure 14:
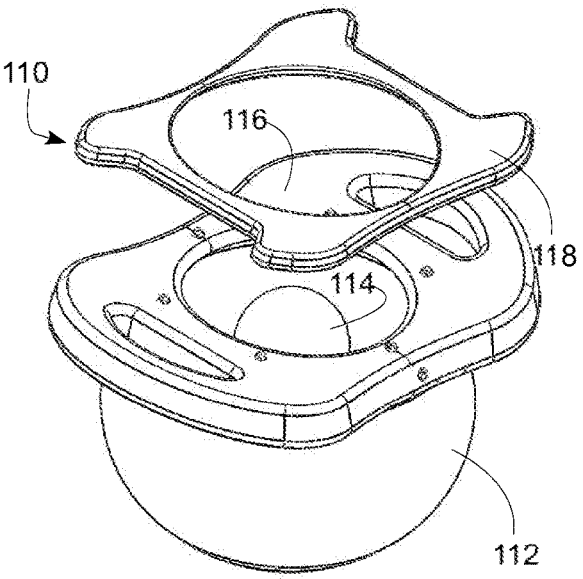
FIG. 14 is an exploded perspective view of the hygienic pacifier of FIG. 13.

FIGS. 10-14 next illustrate a number of alternate processes for forming a hygienic pacifier consistent with the invention. For example, FIG. 10 illustrates a pacifier 90 that is formed by overmolding or co-molding a lower durometer silicon shield 92 and nipple 94 with a higher durometer plastic or silicon faceplate 96. FIGS. 11 and 12 illustrate a pacifier 100 that is formed by overmolding or co-molding a lower durometer silicon shield 102, nipple 104 and faceplate 106 with a higher durometer plastic or silicon backing plate 108, such that a multi-durometer faceplate is formed by faceplate 106 and backing plate 108. Similarly, FIGS. 13 and 14 illustrate a pacifier 110 that is formed by embedding a higher durometer plastic or silicon material 118 within a unitary a lower durometer silicon shield 112, nipple 114 and faceplate 116, such that a multi-durometer faceplate is formed by faceplate 116 and material 118.

In each of the embodiments illustrated in FIGS. 4-10, the higher durometer material in the faceplate is illustrated as being formed as a single, unitary piece that fully circumscribes the nipple access opening. It will be appreciated, however, that in other embodiments the higher durometer material may be formed of multiple pieces such that lower durometer material may be formed within one or more gaps between the multiple pieces to serve as one or more break points to expand the nipple access opening during withdrawal of the bulbous core of the mold. In addition, in some embodiments one or more pieces of the high durometer material may have gaps defined to serve a similar opening expansion function. For example, in some embodiments a single unitary piece of higher durometer material may be formed in a "C" shape with a single gap disposed proximate the top or bottom of a nipple access opening and capable of receiving lower durometer material to serve as a break point within that gap. Other variations will be apparent to those of ordinary skill having the benefit of the instant disclosure.

It will be appreciated that the construction and materials used for a shield (e.g., shield 34 of pacifier 30) may vary in different embodiments, and in particular, may be selected to appropriately balance usability by an infant in the use position and recoil into the storage position upon dropping. It is desirable for shield 34 to be biased to the storage position such that, upon release of nipple by an infant, the nipple is automatically recoiled into the storage position prior to the pacifier hitting the floor or other surface. However, an excessive force requirement to maintain a pacifier in the use position and oppose the recoil bias may lead to recoil in the absence of sufficient sucking by an infant. Moreover, it is desirable in some embodiments to inhibit any locking or overextension of a nipple in the use position to such an extent that the shield is unable to automatically recoil the nipple into the storage position upon dropping.

Figure 15:
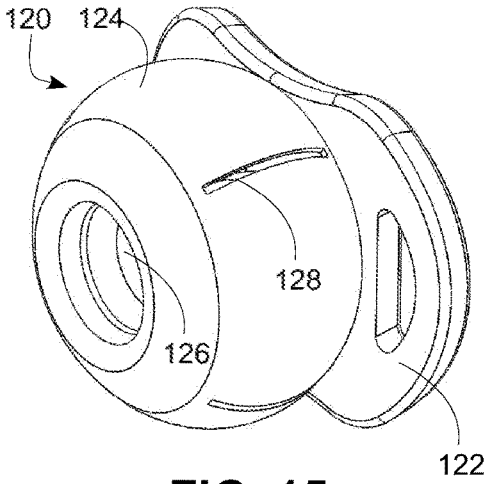
FIG. 15 is a perspective view of another example hygienic pacifier.
Figure 16:
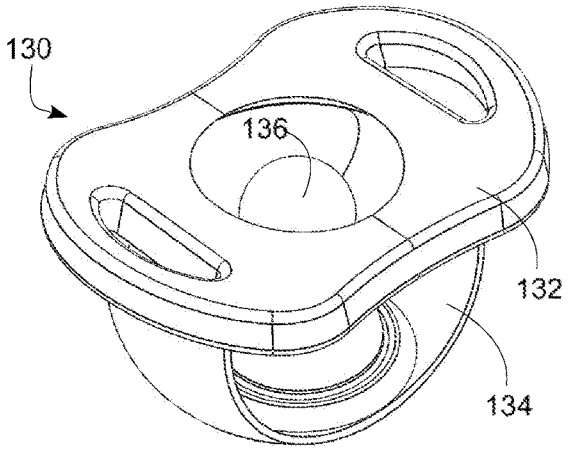
FIG. 16 is a perspective view of yet another example hygienic pacifier.

In some embodiments, this balance may be obtained through selection of an appropriate shield profile, material and/or material thickness. In other embodiments, however, additional structural configurations may be used to provide desired functionality. FIG. 15, for example, illustrates a hygienic pacifier 120 including a faceplate 122, shield 124 and nipple 126, with the shield 124 including one or more tension-reducing apertures 128 configured as slits extending generally between faceplate 122 and a base of the nipple (e.g., generally transverse to faceplate 122) to reduce tension in the shield 124 when in the extended use position. Likewise, pacifier 130 of FIG. 16 includes a faceplate 132, shield 134 and nipple 136, and further implements a similar tension reduction by utilizing apertures configured as open sides on shield 134. It will be appreciated that in other embodiments, different numbers, widths and arrangements (e.g., extending at acute angles relative to the faceplate) of slits or openings may be used on a shield to vary the tension and/or other recoil properties of the shield.

Figure 17:
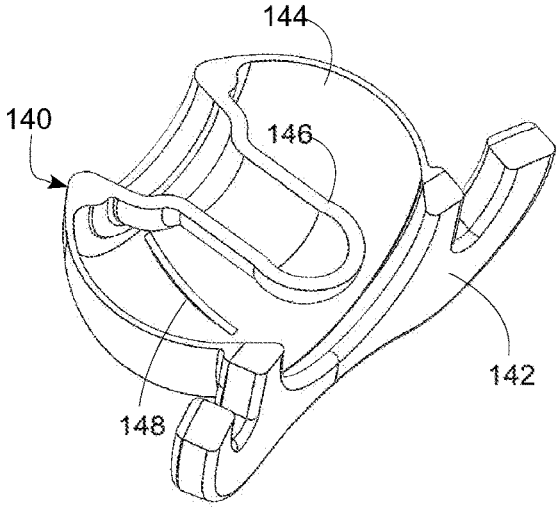
FIG. 17 is a cross-sectional perspective view of another example hygienic pacifier.
Figure 18:
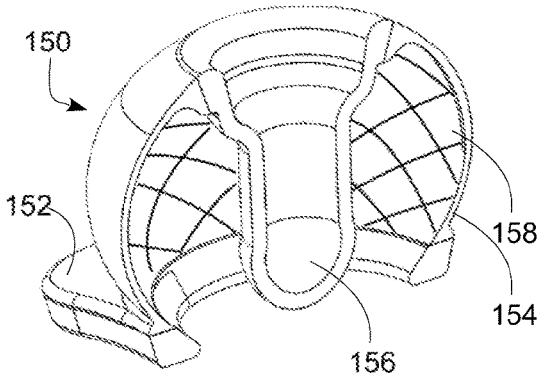
FIG. 18 is a cross-sectional perspective view of yet another example hygienic pacifier.

In addition, in some embodiments ribs or other structures may be formed on an inner and/or outer surface of shield to vary the tension and/or other recoil properties of the shield. For example, FIG. 17 illustrates a hygienic pacifier 140 including a faceplate 142, shield 144 and nipple 146, and further including one or more ribs 148 extending generally transverse to faceplate 142 along an inner surface of shield 144 to inhibit the shield from stopping in a partially recoiled position. Similarly, FIG. 18 illustrates a hygienic pacifier 150 including a faceplate 152, shield 154 and nipple 156, and further including an embossed or debossed pattern 158 (e.g., a crisscross pattern) on the inner surface of shield 154 to inhibit the shield from stopping in a partially recoiled position. In addition, in some embodiments, pattern 158 may also create a number of small "boundaries" to inhibit any tears that form in shield 154 from growing larger. The use of ribs, embossed patterns or debossed patterns, may also advantageously improve the integrity of a shield without thickening the entire shield, which might otherwise unnecessarily increase the tension of the shield. It will be appreciated that a wide variety of alternate patterns and/or rib configurations may be used in other embodiments to provide desirable tension and/or other recoil properties for a shield.

Figure 19:
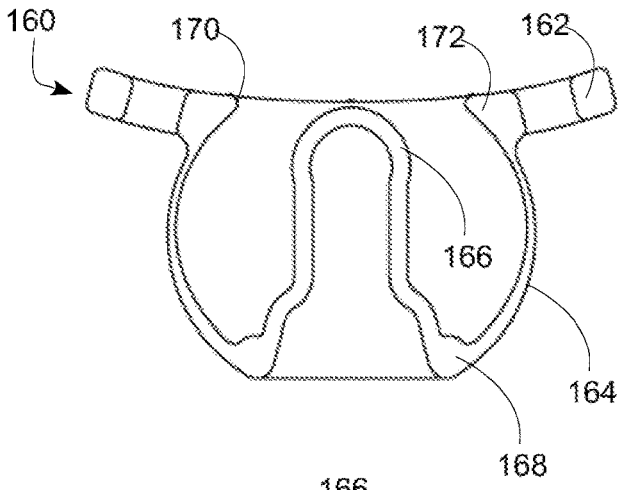
FIG. 19 is a cross-sectional elevational view of another example hygienic pacifier in a recoiled storage position.
Figure 20:
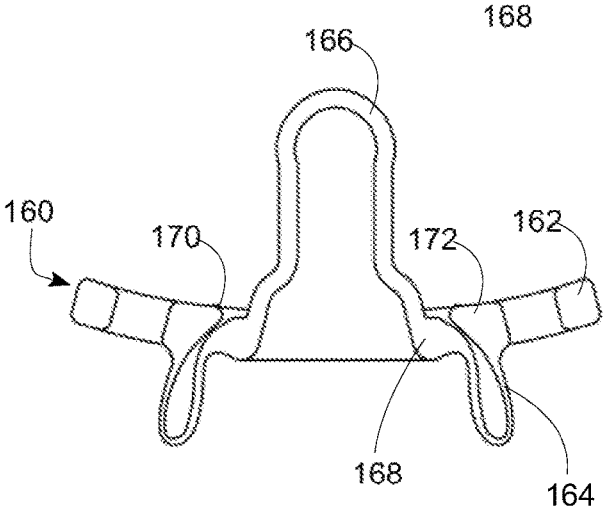
FIG. 20 is a cross-sectional elevational view of the hygienic pacifier of FIG. 19 in an extended use position.

Now turning to FIGS. 19 and 20, it may also be desirable in some embodiments to configure the base supporting a nipple and a nipple access opening on a faceplate to inhibit overextension of a nipple through the nipple access opening. FIG. 19, for example, illustrates a hygienic pacifier 160 including a faceplate 162, shield 164 and nipple 166. A base 168 of nipple 166 is annular in shape and joins nipple 166 to shield 164, and is relatively thicker in cross-section than either nipple 166 or shield 164. Similarly, faceplate 162 includes a nipple access opening 170 that includes an annular shoulder 172 that may in some embodiments be thicker than the rest of faceplate 162. Further, in some embodiments, both base 168 and shoulder 172 have cooperative angled surfaces such that, as illustrated in FIG. 20, when nipple 166 is extended into the use position, base 168 and shoulder 172 engage one another to resist overextension of nipple 166 beyond nipple access opening 170.

Figure 21:
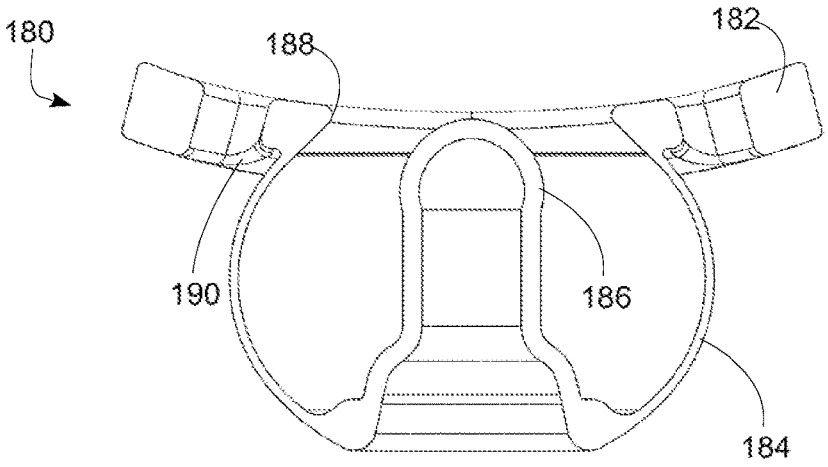
FIG. 21 is a cross-sectional perspective view of another example hygienic pacifier.

In addition, as illustrated in FIG. 21, it may be desirable in some embodiments to narrow a faceplate proximate the nipple access opening to reduce the tension the faceplate exerts on the shield, as well as to reduce the weight of the pacifier. FIG. 21, in particular, illustrates a hygienic pacifier 180 including a faceplate 182, shield 184 and nipple 186, and with the thickness of faceplate 182 proximate nipple access opening 188 to form an annular narrowing shoulder 190 that reduces the tension applied by the faceplate on the shield.

Figure 22:
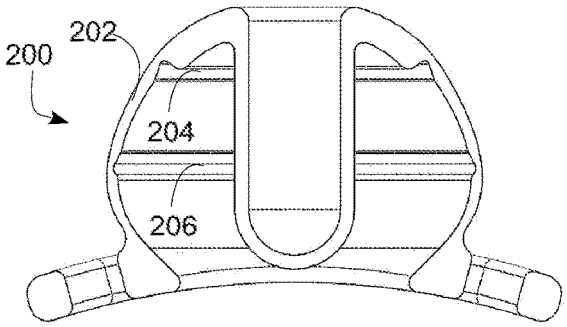
FIG. 22 is a cross-sectional perspective view of yet another example hygienic pacifier.
Figure 23:
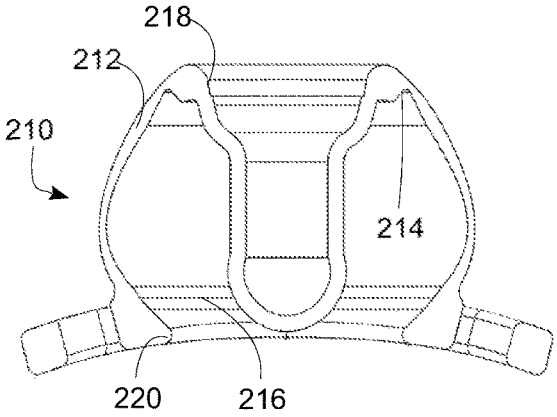
FIG. 23 is a cross-sectional perspective view of another example hygienic pacifier.

As noted above, it is desirable in many embodiments to provide a bias in the shield to urge the nipple into the retracted storage position. In other embodiments, however, it may be desirable to enable a pacifier to be locked or otherwise biased into an extended use position. To do so, it may be desirable to include one or more annular folding structures, e.g., ridges, on an inner or outer surface of a shield. FIG. 22, for example, illustrates a hygienic pacifier 200 including a shield 202 with first and second annular ridges 204, 206 disposed on an inner surface of the shield, e.g., to divide the shield into roughly three portions. FIG. 23 similarly illustrates a hygienic pacifier 210 including a shield 212 having first and second annular ridges 214 and 216 disposed on the inner surface of the shield, but positioned respectively proximate a nipple base 218 and nipple access opening 220 of the pacifier. Further, in some embodiments, a ridge or other structure may be formed on the inner surface of a nipple access opening to provide frictional engagement with the base of the nipple to further restrict return of the nipple to the storage position when fully extended into the use position.

Figure 24:
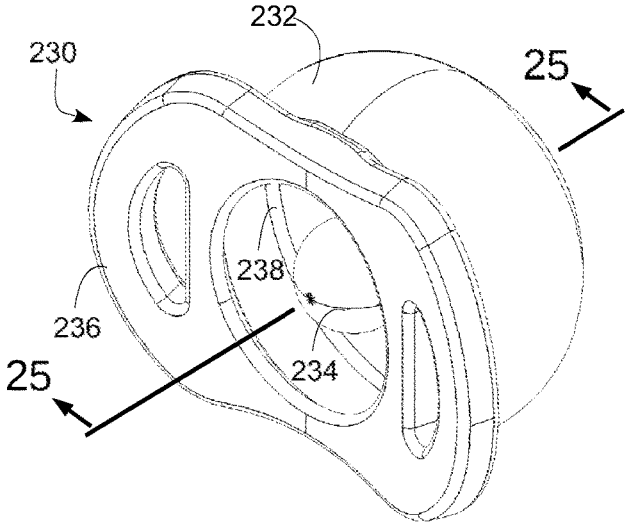
FIG. 24 is a perspective view of another example hygienic pacifier including an annular folding structure consistent with the invention.
Figure 25:
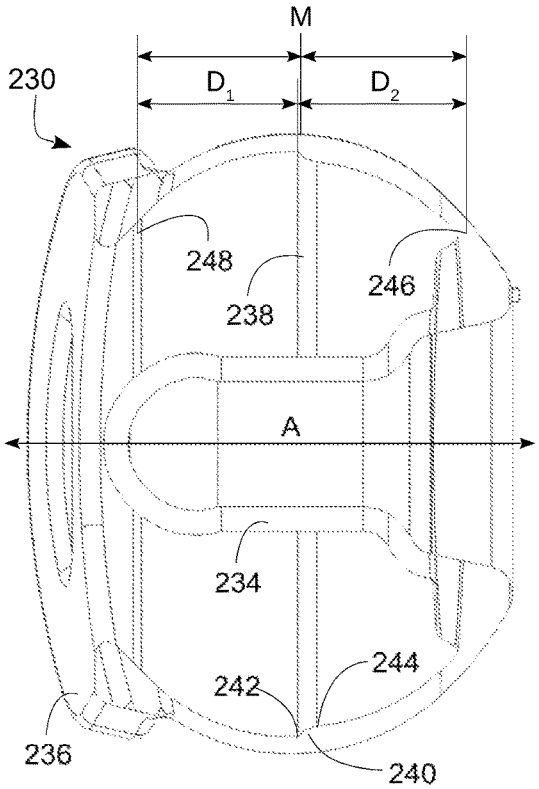
FIG. 25 is a side cross-sectional view of the hygienic pacifier of FIG. 24, taken along lines 25-25.

FIGS. 24-25 illustrate another hygienic pacifier 230 that incorporates a shield 232 extending between the base of a nipple 234 and a faceplate 236, and including an annular folding structure 238 defined on an interior surface of shield 232. In this embodiment, annular folding structure 238 is defined by a shoulder or ridge 240 that joins a thinner section of shield 232 at a first, faceplate end 242 facing faceplate 236 to a thicker section of shield 232 at a second, nipple base end 244 facing the base of nipple 234. In addition, in the illustrated embodiment, at least a portion of annular folding structure 238 is positioned on the faceplate side of a midpoint M of shield 232 along an axis A.

Axis A is an axis that is substantially parallel to nipple 234 and along which nipple 234 moves when transitioning between the recoiled storage and extended use positions. Midpoint M is defined as the midpoint between a center of a flex point for shield 232 at the base of nipple 234 (illustrated at 246) and a resting place of the flex point on faceplate 236 when the shield is in the extended use position (illustrated at 248). In the illustrated embodiment, the faceplate end 242 of annular folding structure 238 is positioned at a location to the faceplate side of midpoint M, such that the distance $D_1$ from the faceplate end 242 of annular folding structure 238 to resting place 248 is shorter than a distance $D_2$ from the faceplate end 242 of annular folding structure 238 to the center of flex point 246.

It will be appreciated that at least some of the other embodiments discussed above are generally biased towards the recoiled storage position regardless of the current position of the nipple along axis A, such that in use the pacifier remains in the extended use position only when an infant is actively sucking or engaging with the nipple. Once an infant releases the nipple, as may occur when the infant falls asleep, the nipple may recoil to the recoiled storage position.

The position and configuration of annular folding structure 238 of pacifier 230, however, may be used to at least temporarily lock or bias the pacifier in the extended use position whenever the pacifier has been placed into the extended use position. Further, in some instances, the annular folding structure 238 may be configured to provide a bias that may be overcome by a moderate impact to the pacifier such as an impact associated with dropping the pacifier.

In particular, the relatively hard line formed by shoulder 240 may create a natural fold point for the shield to urge the shield and nipple towards the extended use position when folded. Doing so may overcome the pull-back force on the nipple when the pacifier is in the extended use position, thereby allowing an infant to take a break from sucking without the nipple immediately recoiling. When the pacifier is dropped, however, the impact may be sufficient to overcome the bias of the annular folding structure to cause the pacifier to automatically recoil to the recoiled storage position and thereby protect the nipple from contacting the ground. In this regard, annular folding structure 238 may be considered to maintain the pacifier in an unstable equilibrium or suspended state when the pacifier is in the extended use position since the pacifier will generally remain in the extended use position in the absence of an external force, but will automatically recoil in response to a sufficient external force that disrupts the suspended state.

It will be appreciated, however, that in other embodiments, it may be desirable to configure the annular folding structure to provide a larger bias that will generally not be overcome when the pacifier is dropped such that the pacifier will generally remain in each of the extended use and recoiled storage positions when manually placed in those positions by a user. In such embodiments, a ridge or other structure may also be formed on the inner surface of a nipple access opening to provide frictional engagement with the base of the nipple to further restrict return of the nipple to the storage position when fully extended into the use position.

The manner in which a pacifier may be configured to support a suspended state when in the extended use position may vary in different embodiments, and may in some embodiments be vary upon a number of different factors.

One such factor may relate to the position of the annular folding structure 238 along the axis A extending substantially parallel to the nipple between the base of nipple 234 and faceplate 236. As noted above, the annular folding structure 238 may be slightly off-center, towards the faceplate, as represented by distance $D_1$ being shorter than distance $D_2$. Doing so urges the shield to rest in a slightly further extended position than it is able to due to the fact that the base of the nipple will meet the faceplate just before the fold-over is 100% complete. As such, a bias pushing the base of the nipple against the faceplate will be present when the pacifier is in the extended use position. The amount of this bias, moreover, may be controlled in part based upon the relative distances $D_1$ and $D_2$, such that the amount of force necessary to disrupt the suspended state and cause the pacifier to recoil to the recoiled storage position may vary based upon the position of the annular folding structure.

Another factor may relate to the configuration of the annual folding structure itself. In the configuration illustrated in FIGS. 24 and 25, for example, shoulder 240 has a rounded cross-section towards the base of the nipple (e.g., is convex facing inwardly from the shield), which due in part to the extra thickness at the crease point, the material is inhibited from forming a sharp crease, which would increase the force needed to overcome the bias maintaining the pacifier in the extended use position. Put another way, the crease defined at end 242 facing faceguard 236 is sharper than that defined at end 244 facing the base of nipple 234. The extra thickness in some embodiments may keep the fold slightly open, which may assist with overcoming the bias maintaining the pacifier in the extended use position. It is believed that the smooth, round nature of this extra thickness may enable the shield to "roll" through the recoil upon impact without getting stuck in the extended use position.

Other factors that may impact the degree of bias that an annular folding structure may provide include the types of material(s), the configuration of the nipple access opening and/or nipple base, and the thickness of the shield. Moreover, it will be appreciated that the configuration of annular folding structure as illustrated in FIGS. 24 and 25 is not exclusive, and as such, other configurations may be used, e.g., by incorporating a crease line on the exterior of the shield in addition to or in lieu of that formed on the interior of the shield, by varying the thicknesses on the faceplate and/or nipple base sides of the structure, by incorporating multiple crease lines, etc. Moreover, as illustrated by FIGS. 22 and 23 discussed above, multiple annular folding structures may be used in some embodiments. Other variations will be apparent to those of ordinary skill having the benefit of the instant disclosure.

It will be appreciated that a number of variations may also be made to the cosmetic design of a pacifier. For example, in some embodiments, different colors may be used for different components of a pacifier to provide contrasting color schemes. For example, in some embodiments, materials 48, 50 of pacifier 30 of FIGS. 4-8 may be formed with different colors such that portions 62, 64 are visually contrasting from faceplate 38. Further, other faceplate designs may be used in other embodiments.

While the embodiments disclosed herein are exemplary, various changes and modifications can be made without departing from the spirit and scope of the present disclosure.

What is claimed is:

1. A hygienic pacifier comprising:

a nipple having a base;

a faceplate defining a nipple access opening; and a substantially spherical shield joining the nipple to the faceplate and being movable between a recoiled storage position in which the shield substantially surrounds the nipple and an extended use position in which at least a portion of the nipple projects through the nipple access opening and is exposed for use;

wherein the shield includes an annular folding structure defined thereon that defines a crease line on the shield that biases the shield to maintain the shield in the extended use position.

2. The hygienic pacifier of claim 1, wherein the nipple access opening of the faceplate is sized and configured to frictionally engage the base of the nipple to further restrict return of the nipple to the recoiled storage position when the shield is in the extended use position.

3. The hygienic pacifier of claim 1, wherein the nipple and faceplate are integrally formed with the shield.

4. The hygienic pacifier of claim 1, wherein the faceplate includes an annular shoulder circumscribing the nipple access opening, wherein the base is annular and configured to engage the annular shoulder when the shield is in the extended use position to inhibit overextension of the nipple beyond the nipple access opening.

5. The hygienic pacifier of claim 1, wherein the faceplate includes an annular narrowing shoulder circumscribing the nipple access opening and reducing tension applied by the faceplate on the shield.

6. The hygienic pacifier of claim 1, wherein the shield is biased to the recoiled storage position, and wherein the annular folding structure is configured to overcome the bias of the shield when the shield is in the extended use position.

7. The hygienic pacifier of claim 6, wherein the annular folding structure is configured to bias the shield to maintain the shield in the extended use position in an absence of an external impact force, and wherein the shield is configured to overcome the bias of the annular folding structure in the presence of an external impact force.

8. The hygienic pacifier of claim 6, wherein the annular folding structure is configured to bias the shield to maintain the shield in the extended use position when an infant ceases sucking on the nipple, and wherein the shield is configured to overcome the bias of the annular folding structure when the pacifier is dropped.

9. The hygienic pacifier of claim 6, wherein the annular folding structure is configured to bias the shield to maintain the shield in the extended use position in the presence of an external impact force.

10. The hygienic pacifier of claim 1, wherein the crease line is defined on an interior of the shield.

11. The hygienic pacifier of claim 10, wherein the crease line is positioned on a faceplate side of a midpoint of the shield along an axis substantially parallel to the nipple such that when the shield is in the extended use position, the base of the nipple contacts the faceplate before the shield can fully fold over.

12. The hygienic pacifier of claim 10, wherein a first distance from the crease line to the faceplate along an axis substantially parallel to the nipple is less than a second distance from the crease line to the base of the nipple along the axis such that when the shield is in the extended use position, the base of the nipple contacts the faceplate before the shield can fully fold over.

13. The hygienic pacifier of claim 10, wherein the shield is thinner proximate a faceplate end of the annular folding structure than proximate a nipple base end of the annular folding structure.

14. The hygienic pacifier of claim 13, wherein the annular folding structure includes a shoulder that is rounded proximate the nipple base end and that defines the crease line proximate the faceplate end.

15. The hygienic pacifier of claim 14, wherein the shoulder is convex facing inwardly from the shield.

16. A hygienic pacifier comprising:

a nipple having a base;

a faceplate defining a nipple access opening; and a substantially spherical shield joining the nipple to the faceplate and being movable between a recoiled storage position in which the shield substantially surrounds the nipple and an extended use position in which at least a portion of the nipple projects through the nipple access opening and is exposed for use;

wherein the shield includes an annular ridge defined thereon that biases the shield to maintain the shield in the extended use position.

17. The hygienic pacifier of claim 16, wherein the shield is thinner proximate a faceplate end of the annular ridge than proximate a nipple base end of the annular ridge.

18. The hygienic pacifier of claim 16, wherein the annular ridge comprises a shoulder that defines a crease line on an interior of the shield.

19. The hygienic pacifier of claim 18, wherein the shoulder is rounded proximate a nipple base end of the annular ridge and defines a crease line proximate a faceplate end of the annular ridge.

20. The hygienic pacifier of claim 18, wherein a first distance from the crease line to the faceplate along an axis substantially parallel to the nipple is less than a second distance from the crease line to the base of the nipple along the axis such that when the shield is in the extended use position, the base of the nipple contacts the faceplate before the shield can fully fold over.

* * * * *